US011165153B2

(12) United States Patent
Qu

(10) Patent No.: US 11,165,153 B2
(45) Date of Patent: Nov. 2, 2021

(54) ANTENNA AND TERMINAL

(71) Applicant: Beijing Xiaomi Mobile Software Co., Ltd., Beijing (CN)

(72) Inventor: Haitao Qu, Beijing (CN)

(73) Assignee: Beijing Xiaomi Mobile Software Co., Ltd., Beijing (CN)

( * ) Notice: Subject to any disclaimer, the term of this patent is extended or adjusted under 35 U.S.C. 154(b) by 0 days.

(21) Appl. No.: 16/710,797

(22) Filed: Dec. 11, 2019

(65) Prior Publication Data

US 2020/0343637 A1 Oct. 29, 2020

(30) Foreign Application Priority Data

Apr. 29, 2019 (CN) ..... 201910354240.4

(51) Int. Cl.
*H01Q 5/357* (2015.01)
*H01Q 1/38* (2006.01)
*H01Q 1/50* (2006.01)

(52) U.S. Cl.
CPC ..... *H01Q 5/357* (2015.01); *H01Q 1/38* (2013.01); *H01Q 1/50* (2013.01)

(58) Field of Classification Search
CPC ..... H01Q 5/357; H01Q 1/38; H01Q 1/50; H01Q 1/243; H01Q 9/42; H01Q 5/371; H01Q 1/36; H01Q 1/48; H01Q 1/22; H01Q 5/20; H01Q 5/307
See application file for complete search history.

(56) References Cited

U.S. PATENT DOCUMENTS 10,205,239 B1 * 2/2019 Contopanagos et al.
10,522,915 B2 * 12/2019 Kenkel ..... H01Q 9/0414
2004/0137950 A1 7/2004 Bolin et al.
2016/0118713 A1 4/2016 Hong et al.
2016/0190700 A1 6/2016 Wang et al.
2016/0329628 A1 11/2016 Kim et al.
2017/0324150 A1 * 11/2017 Liu ..... H01Q 5/35
(Continued)

FOREIGN PATENT DOCUMENTS

CN 1695268 A 11/2005
CN 101499556 A * 8/2009
(Continued)

OTHER PUBLICATIONS

First Office Action dated Apr. 1, 2021, from The State Intellectual Property Office of People's Republic of China in counterpart Chinese Application No. 201910354240.4.*
(Continued)

*Primary Examiner* — Seung H Lee
(74) *Attorney, Agent, or Firm* — Finnegan, Henderson, Farabow, Garrett & Dunner, L.L.P.

(57) ABSTRACT

An antenna applicable to a terminal, includes: a grounding area, a first radiator, a second radiator, and a feeding point connected to both the first radiator and the second radiator; wherein the grounding area is connected to the first radiator and the second radiator respectively and is provided with a grounding point thereon; a slot-coupling is provided between the first radiator and the second radiator; and the first radiator has an operating frequency band in a 5G frequency band and the second radiator has an operating frequency band in a 4G frequency band.

11 Claims, 2 Drawing Sheets

(56) References Cited

U.S. PATENT DOCUMENTS

| | | | | |
|---|---|---|---|---|
| 2017/0358838 | A1* | 12/2017 | Huang | H01Q 9/14 |
| 2017/0358861 | A1 | 12/2017 | Quinlan et al. | |
| 2018/0083367 | A1* | 3/2018 | Song | H01Q 1/521 |
| 2019/0020111 | A1* | 1/2019 | Tseng | H01Q 1/48 |

FOREIGN PATENT DOCUMENTS

| | | | | |
|---|---|---|---|---|
| CN | 202423552 | U | * | 9/2012 |
| CN | 104241856 | A | * | 12/2014 |
| CN | 204441460 | U | * | 7/2015 |
| CN | 204558641 | U | * | 8/2015 |
| CN | 105870586 | A | | 8/2016 |
| CN | 205488524 | U | * | 8/2016 |
| CN | 206211012 | U | * | 5/2017 |
| CN | 106887671 | A | | 6/2017 |
| CN | 206401516 | U | | 8/2017 |
| CN | 207183519 | U | | 4/2018 |
| CN | 108417970 | A | * | 8/2018 |
| CN | 207800900 | U | | 8/2018 |
| CN | 108511890 | A | * | 9/2018 |
| CN | 108899634 | A | * | 11/2018 |
| CN | 109149086 | A | | 1/2019 |
| CN | 208548462 | U | * | 2/2019 |
| CN | 109509962 | A | * | 3/2019 |
| CN | 109509965 | A | | 3/2019 |
| CN | 109687111 | A | | 4/2019 |
| CN | 208690493 | U | | 4/2019 |
| CN | 109983618 | A | | 7/2019 |
| DE | 10331281 | A1 | | 2/2004 |
| EP | 1 094 542 | A2 | | 4/2001 |
| EP | 2 063 488 | A1 | * | 5/2009 |
| EP | 3 471 208 | A1 | | 4/2019 |
| GB | 2434037 | A | | 7/2007 |
| JP | 2009-239386 | A | | 10/2009 |
| JP | 2014-212534 | A | | 11/2014 |
| KR | 20110010416 | A | | 2/2011 |
| KR | 20140139213 | A | | 12/2014 |
| WO | WO 00/36700 | | | 6/2000 |

OTHER PUBLICATIONS

English version of International Search Report in Application No. PCT/CN2019/098199, from the China National Intellectual Property Administration (ISA/CN), dated Jan. 21, 2020.

First Office Action of Russian Application No. 2019139855/28 dated Jul. 24, 2020.

Extended European Search Report in European Application No. 20150695.3, dated Jun. 23, 2020.

International Search Report of PCT Application No. PCT/CN2019/098199, dated Jan. 21, 2020.

Notification to Grant dated Aug. 3, 2021, from the State Intellectual Property of People's Republic of China, in counterpart Chinese Application No. 201910354240.4.

* cited by examiner

ANTENNA AND TERMINAL

CROSS-REFERENCE TO RELATED APPLICATION

This application is based upon and claims priority to Chinese Patent Application No. 201910354240.4, filed on Apr. 29, 2019, the entire contents of which are incorporated herein by reference.

TECHNICAL FIELD

Embodiments of the present disclosure relate to antenna technologies, and more particularly, to an antenna and a terminal.

BACKGROUND

With the rapid development of communication technologies and terminal technologies, there is an urgent need for data services with high-speed, low-latency and high-throughput.

In related technologies, technicians determine shape and size of an antenna adopted in a terminal through comprehensive consideration on factors such as a profile of the terminal, a layout of component parts inside the terminal and a handheld position by a user, and so on. They also need to dispose the antenna at a proper position in the terminal, so that the disposed antenna can have better performance. The technicians can provide two antennas in the terminal configured to implement 4G and 5G frequency bands, respectively.

However, the two antennas in the above related technologies require a relatively large space in the terminal, which may affect arrangement of other electronic components in the terminal.

SUMMARY

Embodiments of the present disclosure provide an antenna and a terminal.

According to a first aspect of an embodiment of the present disclosure, there is provided an antenna applicable to a terminal, comprising: a grounding area, a first radiator, a second radiator, and a feeding point connected to both the first radiator and the second radiator; wherein the grounding area is connected to the first radiator and the second radiator respectively and is provided with a grounding point thereon; a slot-coupling is formed between the first radiator and the second radiator; and the first radiator has an operating frequency band in a 5G frequency band and the second radiator has an operating frequency in a 4G frequency band.

According to a second aspect of the embodiments of the present disclosure, there is provided a terminal, comprising: an antenna including a grounding area, a first radiator, a second radiator, and a feeding point connected to the first radiator and the second radiator; wherein the grounding area is connected to the first radiator and the second radiator respectively and is provided with a grounding point thereon; a slot-coupling is formed between the first radiator and the second radiator; and the first radiator has an operating frequency band in a 5G frequency band and the second radiator has an operating frequency band in a 4G frequency band.

The technical solutions provided by the embodiments of the present disclosure can include the following beneficial effects.

The first radiator and the second radiator are integrated on one antenna, so the one antenna supports both the 5G and 4G frequency bands at the same time. Therefore, internal space of the terminal occupied by the antenna is saved and effect on the arrangement of other electronic components in the terminal may be avoided.

It is to be understood that both the foregoing general description and the following detailed description are exemplary and explanatory only and are not limits to the disclosure.

BRIEF DESCRIPTION OF THE DRAWINGS

The accompanying drawings, which are incorporated in and constitute a part of this specification, illustrate embodiments consistent with the disclosure and, together with the description, serve to explain the principles of the disclosure.

DETAILED DESCRIPTION

Reference will now be made in detail to exemplary embodiments, examples of which are illustrated in the accompanying drawings. The following description refers to the accompanying drawings in which the same numbers in different drawings represent the same or similar elements unless otherwise represented. The implementations set forth in the following description of exemplary embodiments do not represent all implementations consistent with the invention. Instead, they are merely examples of apparatuses and methods consistent with aspects related to the invention as recited in the appended claims.

An embodiment of the present disclosure provides an antenna applicable to a terminal, which can support 5G and 4G frequency bands simultaneously. For example, the antenna supports N77 and N78 frequency bands in the 5G frequency band and B3 or B41 frequency bands in the 4G frequency band, whereby facilitating the design of a Multi Input Multi Output (MIMO) antenna of the terminal.

In embodiments of the present disclosure, 4G is short for the 4th Generation mobile communication technology, and the 4G communication system can also be referred to as a Long Term Evolution (LTE) system. 5G is short for the 5th Generation mobile communication technology and the 5G communication system can also be called a New Radio (NR) system or a 5G NR system.

In embodiments of the present disclosure, the terminal can be various handheld devices (such as mobile phones, tablet computers), vehicle-mounted devices, wearable devices, computing devices, smart home devices having a wireless communication function, or other processing devices connected to a wireless modem and various forms of user equipment (UE), mobile stations (MS), and terminal devices, and so on. For convenience of description, in the embodiments of the present disclosure, the above-mentioned devices are collectively referred to as terminals.

Figure 1:
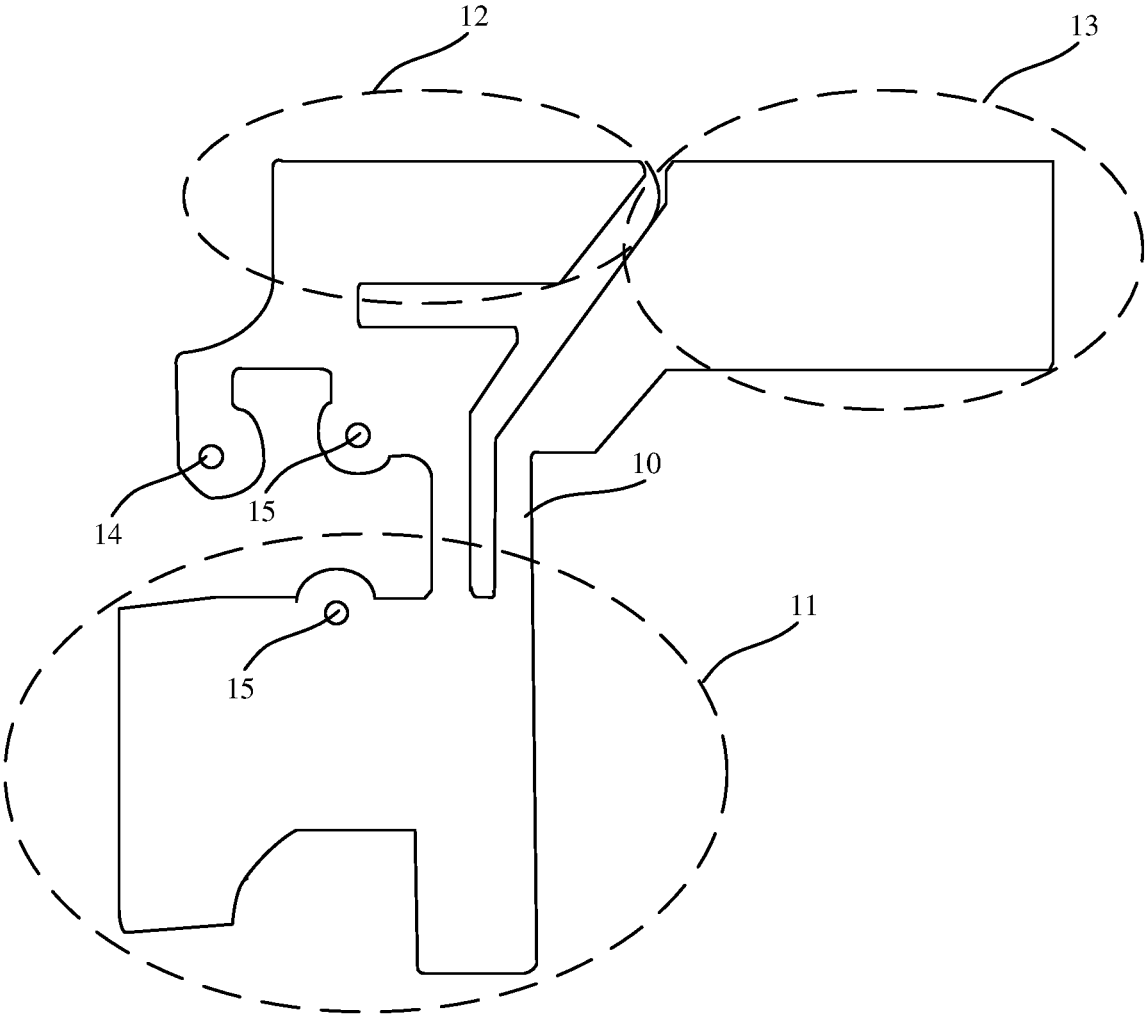
FIG. 1 is a schematic view illustrating an antenna according to an exemplary embodiment.

FIG. 1 is a schematic view illustrating an antenna 10 according to an exemplary embodiment. As illustrated in FIG. 1, the antenna 10 can include a grounding area 11, a first radiator 12, a second radiator 13, and a feeding point 14 connected to both the first radiator 12 and the second radiator 13.

The feeding point 14 can also be referred to as a power supply point, and can be configured to feed a radio frequency signal to the first radiator 12 and the second radiator 13.

The grounding area 11 is connected to the first radiator 12 and the second radiator 13 respectively and is provided with a grounding point 15 thereon. The grounding point 15 can be configured to ground the first radiator 12 and the second radiator 13. In some embodiments, only one grounding point 15 is provided. In other embodiments, a plurality of grounding points 15 are provided, for example two, three or even more. Providing a plurality of grounding points 15 on the antenna 10 meets the demands for frequency bands of different operator versions.

There is a slot between the first radiator 12 and the second radiator 13 and a slot-coupling is formed between the first radiator 12 and the second radiator 13. Shape and size of the slot may have an effect on operating frequency bands of the first radiator 12 and the second radiator 13, so that the shape and size of the slot can be designed according to the actual design requirements of the operating frequency bands of the first radiator 12 and the second radiator 13.

The first radiator 12 has an operating frequency band of 5G and the second radiator 13 has an operating frequency band of 4G. In an example, the operating frequency band of the first radiator 12 is N77 and N78 frequency bands in the 5G frequency band. Namely, the operating frequency band of the first radiator 12 is 3.3 GHz-4.2 GHz frequency band, which supports a bandwidth of 900 MHz. In one example, the operating frequency band of the second radiator 13 is a B3 frequency band, a B41 frequency band or other frequency bands in the 4G frequency band. The above descriptions of the 5G and 4G frequency bands are exemplary and explanatory only and the operating frequency bands of the first radiator 12 and the second radiator 13 can be selected or designed according to actual requirements.

In an embodiment, the antenna 10 is an Inverted-F Antenna (IFA).

In an embodiment, the antenna 10 is a laser direct structuring (LDS) antenna or a flexible printed circuit board (FPC) antenna. The LDS antenna is formed by an LDS technology, which can directly bond an antenna to a non-metal carrier of a terminal by laser. The LDS antenna has characteristics such as stable performance, short manufacturing processes, strong anti-interference capability and high utility rate of space of the terminal. The FPC antenna is formed by an FPC technology, and is connected through a feeder line. The FPC antenna usually can be attached to a non-metal carrier of a terminal with an adhesive, and has characteristics such as good performance, flexible installation, low costs and high gains.

In the embodiments of the present disclosure, the first radiator and the second radiator are integrated on one antenna, so that the one antenna supports both the 5G frequency band and the 4G frequency band at the same time. Therefore, the internal space of the terminal occupied by the antenna is saved and the effect on the arrangement of other electronic components in the terminal is avoided.

In an embodiment, the antenna provided by the embodiment of the present disclosure occupies a small area of about 20*17 $mm^2$.

In an embodiment, a reserved grounding area can be correspondingly adjusted according to the requirements for spectrums of different operators, so as to maximize the performance of antenna.

Figure 2:
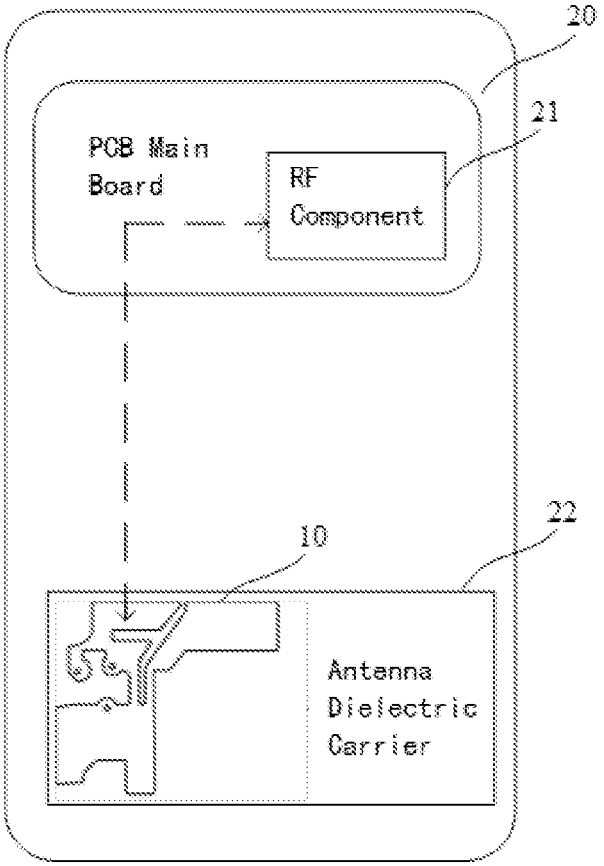
FIG. 2 is a schematic view illustrating a terminal according to an exemplary embodiment.

FIG. 2 is a schematic view illustrating a terminal 20 according to an exemplary embodiment. As illustrated in FIG. 2, the terminal 20 includes the antenna 10 provided by the foregoing embodiment of FIG. 1. The terminal 20 can further include a radio frequency component 21, an antenna printed circuit board (PCB) (not shown) and an antenna dielectric carrier 22.

The radio frequency component 21 can also be referred to as a radio frequency chip configured to transmit and/or receive a signal. The radio frequency component 21 can be integrated on or independent of a PCB main board of the terminal 20, which is not limited in the embodiment of the present disclosure.

Figure 3:
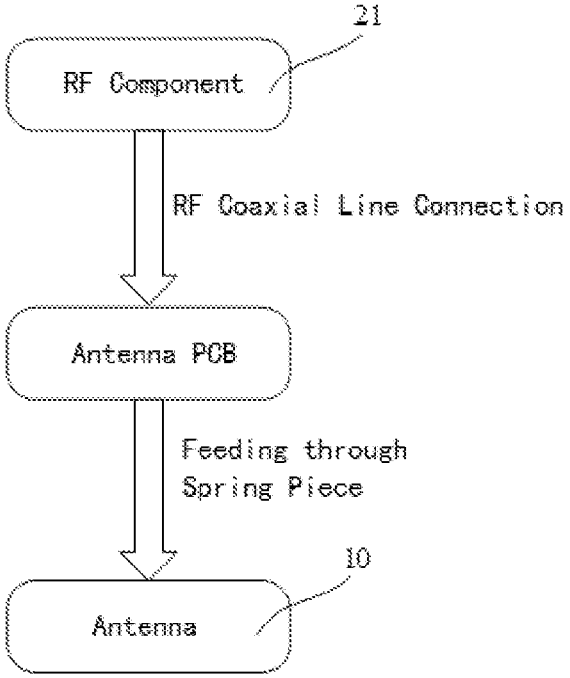
FIG. 3 is a schematic view illustrating connection between a radio frequency component and an antenna according to an exemplary embodiment.

As illustrated in FIG. 3, the radio frequency component 21 is connected to the antenna PCB via a radio frequency coaxial line. The radio frequency coaxial line is configured to transmit a radio frequency signal. The radio frequency coaxial line can also be referred to as a radio frequency coaxial cable, and has performance of broadband and high-rate transmission.

The antenna 10 is disposed on the antenna dielectric carrier 22. The antenna dielectric carrier 22 is configured to carry the antenna 10. The antenna 10 can be attached to the antenna dielectric carrier 22 directly or by the LDS technology. In an embodiment, the antenna dielectric carrier 22 is any one of a speaker box dielectric carrier, a non-metal dielectric carrier and a non-metal back plate. The speaker box is a box in which a speaker is placed, and is made of a non-metal material. The antenna 10 can be disposed on the speaker box. The non-metal dielectric carrier can be component parts made of any non-metal material disposed inside the terminal 20, such as a plastic dielectric carrier, a glass dielectric carrier or a ceramic dielectric carrier. The non-metal back plate is a back plate made of a non-metal material of the terminal 20, and can be a plastic back plate, a glass back plate or a ceramic back plate.

The feeding point of the antenna 10 is connected to a feeding portion on the antenna PCB and the grounding point of the antenna 10 is connected to a grounding portion on the antenna PCB. Schematically, as illustrated in FIG. 3, the feeding point of the antenna 10 and the feeding portion on the antenna PCB are connected through a spring piece and the grounding point of the antenna 10 and the grounding portion on the antenna PCB are connected through a spring piece.

In an embodiment, the antenna dielectric carrier 22 is disposed above the antenna PCB, and a gap may form between the antenna dielectric carrier 22 and the antenna PCB. In an embodiment, a distance between the antenna dielectric carrier 22 and the antenna PCB is at least 0.5 mm to ensure the performance of the antenna 10. In an embodiment, the antenna PCB can have an area substantially the same as that of the antenna dielectric carrier 22.

In an embodiment, in order to ensure the performance of the antenna 10 as much as possible, a back plate of the terminal 20 is made of a non-metal material and a middle frame of the terminal 20 can be made of a metal material or a non-metal material.

It should be noted that a position of the antenna 10 inside the terminal 20 is not limited in the embodiments of the present disclosure. For example, in FIG. 2, the antenna 10 is disposed at a bottom region of the terminal 20. And in other exemplary embodiments, the antenna 10 can be disposed at a top region of the terminal 20 or other positions. An appropriate position for the antenna 10 can be selected based on the overall design requirements of the terminal 20.

In the embodiments of the present disclosure, the first radiator and the second radiator are integrated on one antenna, so that the one antenna supports both the 5G frequency band and the 4G frequency band at the same time. Therefore, internal space of the terminal occupied by the antenna is saved and the effect on the arrangement of other electronic components of the terminal may be avoided.

It should be understood that the term "and/or" describes relationships of associated objects and means that there may be three kinds of relationships. For example, "A and/or B" may denote three situations, namely, A alone, B alone, and both A and B. Character "/" generally means that the associated objects before and after the character are in a relationship of "or".

Other embodiments of the present invention will be apparent to those skilled in the art from consideration of the specification and practice of the invention disclosed here. This application is intended to cover any variations, uses, or adaptations of the present disclosure following the general principles thereof and including such departures from the present disclosure as come within known or customary practice in the art. It is intended that the specification and examples be considered as exemplary only, with a true scope and spirit of the invention being indicated by the following claims.

It will be appreciated that the present disclosure is not limited to the exact construction that has been described above and illustrated in the accompanying drawings, and that various modifications and changes can be made without departing from the scope thereof. It is intended that the scope of the present disclosure only be limited by the appended claims.

What is claimed is:

1. An antenna applicable to a terminal, comprising:

a grounding area, a first radiator, a second radiator, and a feeding point connected to both the first radiator and the second radiator;

wherein the grounding area is connected to the first radiator and the second radiator respectively and is provided with a grounding point thereon;

a slot-coupling is formed between the first radiator and the second radiator, and the first radiator has an operating frequency band in a 5G frequency band and the second radiator has an operating frequency band in a 4G frequency band.

2. The antenna according to claim 1, wherein the operating frequency band of the first radiator is a 3.3 GHz-4.2 GHz frequency band in the 5G frequency band.

3. The antenna according to claim 1, wherein a plurality of the grounding points are provided.

4. The antenna according to claim 1, wherein the antenna is an inverted-F antenna.

5. The antenna according to claim 1, wherein the antenna is a laser direct structuring (LDS) antenna or a flexible printed circuit board (PFC) antenna.

6. A terminal, comprising:

an antenna including a grounding area, a first radiator, a second radiator, and a feeding point connected to both the first radiator and the second radiator;

wherein the grounding area is connected to the first radiator and the second radiator respectively and is provided with a grounding point thereon;

a slot-coupling is formed between the first radiator and the second radiator; and the first radiator has an operating frequency band in a 5G frequency band and the second radiator has an operating frequency band in a 4G frequency band.

7. The terminal according to claim 6, further comprising:

a radio frequency component, an antenna printed circuit board (PCB), and an antenna dielectric carrier;

wherein the radio frequency component and the antenna PCB are connected via a radio frequency coaxial line;

the antenna is disposed on the antenna dielectric carrier; and the feeding point of the antenna is connected to a feeding portion on the antenna PCB and the grounding point of the antenna is connected to a grounding portion on the antenna PCB.

8. The terminal according to claim 7, wherein the antenna dielectric carrier is disposed above the antenna PCB and a gap is formed between the antenna dielectric carrier and the antenna PCB.

9. The terminal according to claim 7, wherein:

the feeding point of the antenna is connected to the feeding portion on the antenna PCB through a spring piece.

10. The terminal according to claim 7, wherein:

the grounding point of the antenna is connected to the grounding portion on the antenna PCB via a spring piece.

11. The terminal according to claim 7, wherein the antenna dielectric carrier is any one of a speaker box dielectric carrier, a non-metal dielectric carrier, and a non-metal back plate.

* * * * *